US007772740B2

(12) United States Patent
Tussing et al.

(10) Patent No.: US 7,772,740 B2
(45) Date of Patent: Aug. 10, 2010

(54) BRUSH HOLDER

(75) Inventors: Torsten Tussing, Saarbrücken (DE); Helmut Burger, Moorenweis (DE); Jens Frenzel, Landsberg (DE)

(73) Assignee: Hilti Aktiengesellschaft, Schaan (LI)

( * ) Notice: Subject to any disclaimer, the term of this patent is extended or adjusted under 35 U.S.C. 154(b) by 199 days.

(21) Appl. No.: 11/985,302

(22) Filed: Nov. 13, 2007

(65) Prior Publication Data

US 2008/0111441 A1 May 15, 2008

(30) Foreign Application Priority Data

Nov. 14, 2006 (DE) ..... 10 2006 035 441

(51) Int. Cl.
*H01R 39/36* (2006.01)
*H01R 39/41* (2006.01)

(52) U.S. Cl. ..... 310/242; 310/239; 310/245

(58) Field of Classification Search ..... 310/242, 310/245

See application file for complete search history.

(56) References Cited

U.S. PATENT DOCUMENTS 4,409,508 A * 10/1983 Ooki et al. ..... 310/239
5,648,695 A * 7/1997 Yamaguchi et al. ..... 310/242
6,680,556 B2 * 1/2004 Menz et al. ..... 310/239

FOREIGN PATENT DOCUMENTS

JP 57-028544 A * 2/1982

* cited by examiner

*Primary Examiner*—Burton Mullins
(74) *Attorney, Agent, or Firm*—Abelman, Frayne & Schwab

(57) ABSTRACT

A brush holder (2) has a carbon holder (4) which forms a guide (38) for a carbon brush (6) and at which a holding spring (10) that presses the carbon brush (6) against a first guide side of the guide (38) with a holding pressure force (HF), is provided, with the holding spring (10) having two portions (12, 21) which are biased against one another, and with the carbon holder (4) and the carbon brush (6) projecting through between the two portions (12, 21).

2 Claims, 2 Drawing Sheets

BRUSH HOLDER

BACKGROUND OF THE INVENTION

1. Field of the Invention

The invention is directed to a brush holder having at least one carbon holder which forms a guide for a carbon brush and at which a holding spring is provided, which holding spring presses the carbon brush against a first guide side of the guide with a holding pressure.

2. Description of the Prior Art

In brush holders of the type mentioned above, vibrations which occur during operation, can cause the carbon brushes to tilt relative to the carbon holder due to movement play. This movement play must be preserved in order to allow the carbon brushes to move along the guide. As a result of the tilting and movement play, increased wear can occur in some areas at a contact surface and at the surfaces which contact the carbon holder. In a brush holder of the type mentioned above, the tilting and resulting wear can be appreciably reduced by pressing the carbon brushes against the guide side.

U.S. Pat. No. 3,526,797 discloses a carbon holder at which a spring arrangement is held in a swivelable manner. The spring arrangement has a rolled flat spring which presses against a front side of a carbon brush remote of the commutator by a rolled portion in a clamping position in order to bias this carbon brush against the commutator. At the same time, a curved area at a free end of the flat spring presses the carbon brush against a guide wall of the carbon holder.

The drawback of the known carbon holder consists in that the spring arrangement has a very complicated shape which in turn requires a special receptacle at the carbon holder. This results in very high overall production costs for the brush holder. Further, the curved area which presses laterally against the carbon brush generates a line tension which cuts into the carbon brush increasingly due to vibrations occurring in operation.

SUMMARY OF THE INVENTION

It is the object of the present invention to provide a brush holder in which the drawbacks of the known holder are eliminated, and wear of the carbon brushes is reduced in an economical manner.

These and other objects of the present invention, which will become apparent hereinafter, are achieved by providing a brush holder in which the holding spring has two portions preloaded against one another and between which portions of the carbon holder and portions of the carbon brush are arranged, one of the portions acting on the carbon holder and the other portion acting on the carbon brush. This makes it possible to press the carbon brush against the carbon holder by means of the holding spring and, accordingly, to reduce the relative movements between the two members which are due to vibrations and which cause wear. The position of the holding spring can be secured by its own bias without having to provide special holding means at the brush holder for this purpose. In addition, a holding spring of this kind can be produced in a simple manner and in many cases can be retrofitted to existing brush holders.

In a particularly preferred embodiment, the holding spring is formed by a U-shaped leaf spring which engages around the carbon holder. Accordingly, the holding spring can be produced in a particularly economical manner.

In an advantageous manner, securing means is provided on a first leg of the holding spring for securing the spring to the carbon holder, and application means, which can contact the carbon brush through a recess in the carbon holder is provided at a second leg. In this way, the holding spring has respective areas which directly contact the carbon holder and carbon brush. The two areas can be formed in such a way that they cooperate with the carbon holder and the carbon brush, respectively, in a particularly suitable manner.

The securing means is preferably formed by a snap-in tab which can snap into a correspondingly shaped receptacle in the carbon holder. In this way, the holding spring can be secured in the intended position by its own bias in a particularly stable manner.

The application means advantageously forms a contact surface which contacts the carbon brush in a planar manner. Accordingly, the pressure tension between the application means and the carbon brush can be kept relatively small while maintaining the same pressing force, which in turn reduces wear in this area.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

BRIEF DESCRIPTION OF THE DRAWINGS

The invention will be described in more detail in the following with reference to an embodiment example.

The drawings show.

DETAILED DESCRIPTION OF THE PREFERRED EMBODIMENT

Figure 1:
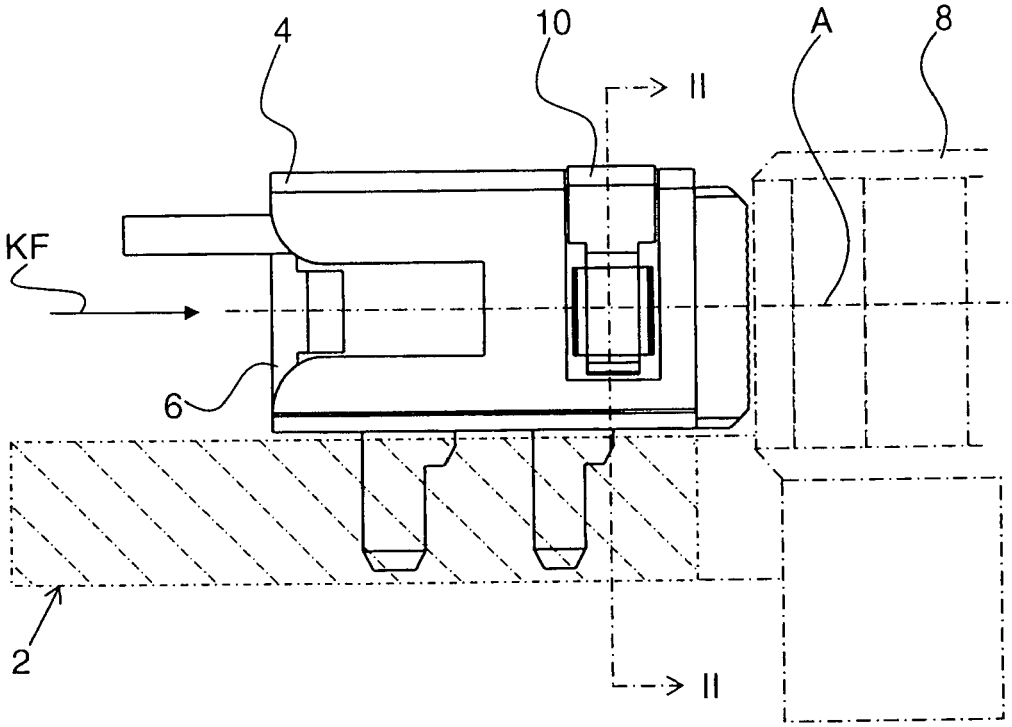
FIG. 1 a side view of a brush holder according to the present invention.

FIG. 1 shows a brush holder 2 of a hand-held power tool and which holds a carbon holder 4. The carbon holder 4 provides for guiding of a carbon brush 6 along a guide axis A which contacts a commutator 8 of a rotor, not shown in more detail. To this end, there is provided a contact spring force KF which biases the carbon brush 6 against the commutator 8.

Figure 2:
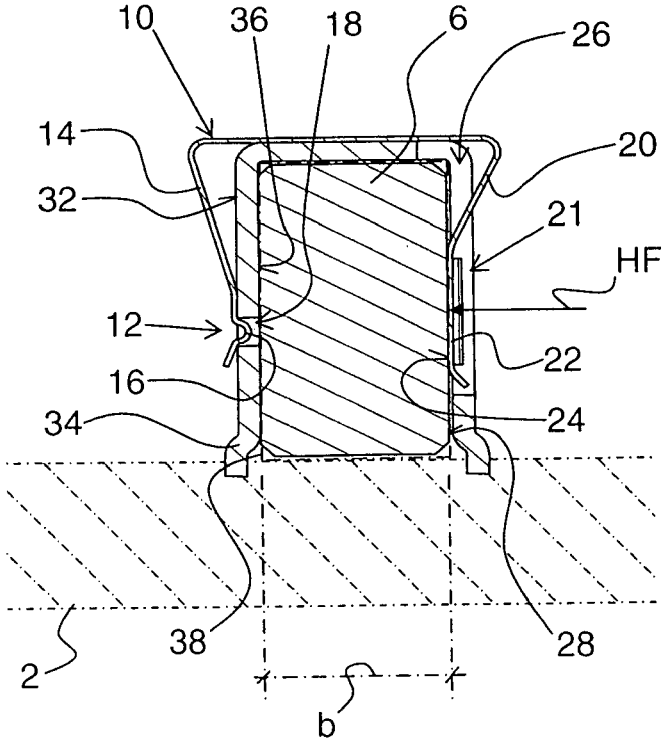
FIG. 2 a cross-sectional view of a carbon holder of the brush holder along line II-II of FIG. 1.

Further, a holding spring 10 is provided at the carbon holder 4. As can be seen from FIGS. 2 and 3 in particular, the holding spring 10 is formed by a substantially U-shaped flat spring. This holding spring 10 has a holding portion 12 which is formed on a first leg 14 and at which securing means 16 is provided. The securing means 16 cooperates with complementary securing means 18 at the carbon holder 4. The securing means 16 is formed as a snap-in tab which engages in a correspondingly dimensioned receptacle functioning as complementary securing means 18.

An application portion 21 formed at a second leg 20 of the holding spring 10 has application means 22 which forms a contact surface 24. The application means 22 projects through a recess 26 of the carbon holder 4 and contacts a side surface 28 of the carbon brush 6.

Figure 3:
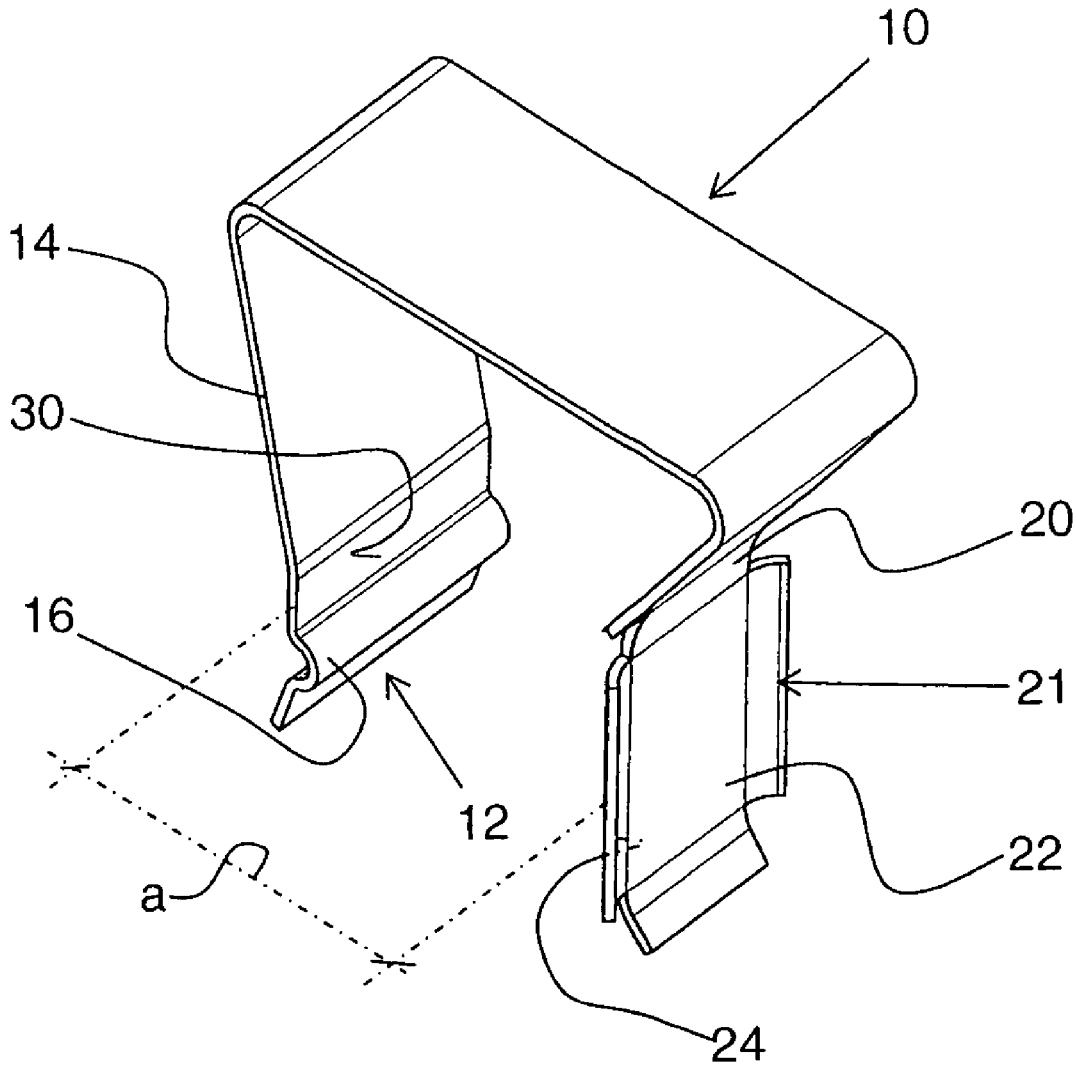
FIG. 3 a detail in a perspective view showing a holding spring of the carbon holder shown in FIG. 2.

In the uninstalled state shown in FIG. 3, the holding spring 10 has a distance a between the contact surface 24 of the second leg 20 and a contact area 30 of the holding portion 12 adjacent to the securing means 16. This distance a is less than a distance b, shown in FIG. 2, between the side surface 28 of the carbon brush 6 and an outer side 32 of a first guide wall 34 of the carbon holder 4 in which the complementary securing means 18 are incorporated. Accordingly, in the installed state of the holding spring 10, in which the latter engages around the carbon holder 4, the first leg 14 and the second leg 20 are biased against one another. Accordingly, the contact surface 24 presses the carbon brush 6 against an inner side 36 of the first guide wall 34 with a holding force HF. The inner side 36 accordingly forms a first guide side of a guide 38 of the carbon holder 4 and the contact surface 24 forms a second guide side of a guide 38 of the carbon holder 4 remote of the first guide side, along which the carbon brush 6 is biased against the commutator 8 by the contact spring force KF.

Though the present invention was shown and described with references to the preferred embodiment such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A brush holder (2), comprising a carbon holder (4) that forms a guide (38) for a carbon brush (6); and a holding spring (10) for biasing the carbon brush (6) against a first guide side of the carbon brush guide (38) with a holding pressure force (HF), the holding spring (10) having two portions (12, 21) preloaded against one another, with portions of the carbon holder (4) and portions of the carbon brush (6) being arranged between the two portions (12, 21) of the holding spring (10), wherein the holding spring (10) is formed as a U-shaped leaf spring engageable around the carbon holder (4), wherein the holding spring (10) has first (14) and second (20) legs, and wherein the brush holder (2) further comprises securing means (16) provided at the first leg (14) of the holding spring (10) for securing the holding spring (10) to the carbon holder (4), and application means (22) which can contact the carbon brush (6) through a recess (26) in the carbon holder (4) and provided at a second leg (20), and wherein the securing means (16) is formed by a snap-in tab which can snap into a correspondingly shaped receptacle in the carbon holder (4).

2. A brush holder according to claim 1 wherein the application means (22) forms a contact surface (24) which contacts the carbon brush (6) in a planar manner.

* * * * *